US008770303B2

(12) United States Patent
Aguirre et al.

(10) Patent No.: US 8,770,303 B2
(45) Date of Patent: Jul. 8, 2014

(54) SELF-ALIGNING OPEN-HOLE TRACTOR

(75) Inventors: Franz Aguirre, Missouri City, TX (US); Todor K. Sheiretov, Houston, TX (US); Keith R. Nelson, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/936,320

(22) Filed: Nov. 7, 2007

(65) Prior Publication Data

US 2008/0196901 A1 Aug. 21, 2008

Related U.S. Application Data

(60) Provisional application No. 60/890,577, filed on Feb. 19, 2007.

(51) Int. Cl.
*E21B 23/00* (2006.01)

(52) U.S. Cl.
USPC ..... 166/381; 166/241.6

(58) Field of Classification Search
CPC ..... E21B 23/00; E21B 4/18
USPC ..... 175/57, 98, 99; 166/241.6, 381
See application file for complete search history.

(56) References Cited

U.S. PATENT DOCUMENTS

| | | | | |
|---|---|---|---|---|
| 2,742,259 | A * | 4/1956 | Boucher | 254/134.5 |
| 2,845,251 | A * | 7/1958 | Barton et al. | 173/27 |
| 2,989,128 | A * | 6/1961 | Gaines, Jr. | 172/447 |
| 3,664,416 | A * | 5/1972 | Nicolas et al. | 166/66.4 |
| 4,050,384 | A * | 9/1977 | Chapman | 104/138.2 |
| 4,192,380 | A * | 3/1980 | Smith | 166/254.2 |
| 4,228,593 | A * | 10/1980 | Frank et al. | 33/544.3 |
| 4,670,862 | A * | 6/1987 | Staron et al. | 367/25 |
| 5,375,530 | A * | 12/1994 | Zollinger et al. | 104/138.2 |
| 5,848,479 | A * | 12/1998 | MacIndoe | 33/542 |
| 6,026,911 | A * | 2/2000 | Angle et al. | 175/24 |
| 6,089,323 | A * | 7/2000 | Newman et al. | 166/381 |
| 6,241,031 | B1 | 6/2001 | Beaufort | |
| 6,273,189 | B1 | 8/2001 | Gissler | |
| 6,347,674 | B1 | 2/2002 | Bloom | |
| 6,378,627 | B1 * | 4/2002 | Tubel et al. | 175/24 |
| 6,427,786 | B2 | 8/2002 | Beaufort | |
| 6,464,003 | B2 | 10/2002 | Bloom | |
| 6,467,557 | B1 | 10/2002 | Krueger | |
| 6,478,097 | B2 | 11/2002 | Bloom | |
| 6,640,894 | B2 | 11/2003 | Bloom | |

(Continued)

FOREIGN PATENT DOCUMENTS

| | | |
|---|---|---|
| GB | 2346908 | 8/2000 |
| GB | 2351308 | 12/2000 |

(Continued)

*Primary Examiner* — Brad Harcourt
(74) *Attorney, Agent, or Firm* — Trevor Grove

(57) ABSTRACT

A downhole tractor assembly that is configured for open-hole applications and of a self-aligning nature. The self-aligning nature of the assembly is effectuated through a tractor portion which is rotable about an axis of an elongated body of the assembly independent of a separate centralizing portion of the assembly. That is, the tractor portion, configured for interfacing an open-hole well wall of potentially irregular morphology, is independently rotable so as to maintain a position of substantially optimized driving friction at the interface during tractoring. Maintenance of optimized driving friction in this manner may occur irrespective of the orientation of the centralizing portion of the assembly.

10 Claims, 4 Drawing Sheets

(56) References Cited

U.S. PATENT DOCUMENTS

| | | | | |
|---|---|---|---|---|
| 6,679,341 | B2 | 1/2004 | Bloom | |
| 6,715,559 | B2 | 4/2004 | Bloom | |
| 6,722,442 | B2 * | 4/2004 | Simpson | 166/381 |
| 6,745,854 | B2 | 6/2004 | Bloom | |
| 6,868,906 | B1 | 3/2005 | Vail | |
| 6,910,533 | B2 * | 6/2005 | Guerrero | 166/206 |
| 6,938,708 | B2 | 9/2005 | Bloom | |
| 7,048,047 | B2 | 5/2006 | Bloom | |
| 7,051,587 | B2 * | 5/2006 | Simpson et al. | 73/152.54 |
| 7,080,700 | B2 | 7/2006 | Bloom | |
| 7,080,701 | B2 | 7/2006 | Bloom | |
| 7,121,364 | B2 | 10/2006 | Mock | |
| 7,143,843 | B2 * | 12/2006 | Doering et al. | 175/24 |
| 7,156,181 | B2 * | 1/2007 | Moore et al. | 166/381 |
| 7,156,192 | B2 * | 1/2007 | Guerrero et al. | 175/51 |
| 7,174,974 | B2 | 2/2007 | Bloom | |
| 7,195,079 | B2 * | 3/2007 | Self et al. | 175/53 |
| 2002/0029908 | A1 | 3/2002 | Bloom | |
| 2002/0104686 | A1 | 8/2002 | Bloom | |
| 2003/0116356 | A1 | 6/2003 | Bloom | |
| 2003/0121703 | A1 | 7/2003 | Bloom | |
| 2003/0183383 | A1 * | 10/2003 | Guerrero | 166/206 |
| 2003/0188875 | A1 | 10/2003 | Bloom | |
| 2004/0245018 | A1 | 12/2004 | Bloom | |
| 2005/0034874 | A1 * | 2/2005 | Guerrero et al. | 166/380 |
| 2005/0082055 | A1 | 4/2005 | Bloom | |
| 2005/0145415 | A1 * | 7/2005 | Doering et al. | 175/24 |
| 2005/0247488 | A1 | 11/2005 | Mock | |
| 2005/0252686 | A1 | 11/2005 | Bloom | |
| 2006/0196694 | A1 | 9/2006 | Bloom | |
| 2006/0196696 | A1 | 9/2006 | Bloom | |
| 2008/0128128 | A1 * | 6/2008 | Vail et al. | 166/250.15 |

FOREIGN PATENT DOCUMENTS

| | | |
|---|---|---|
| GB | 2362405 | 11/2001 |
| GB | 2370056 | 6/2002 |
| GB | 2378468 | 2/2003 |
| GB | 2378469 | 2/2003 |
| GB | 2380755 | 4/2003 |
| GB | 2389135 | 12/2003 |
| GB | 2413816 | 11/2005 |
| GB | 2414499 | 11/2005 |
| WO | 98/12418 | 3/1998 |
| WO | 00/36266 | 6/2000 |
| WO | 00/46481 | 8/2000 |
| WO | 01/09478 | 2/2001 |
| WO | 02/44509 | 6/2002 |
| WO | 2004/072433 | 8/2004 |
| WO | 2004/083595 | 9/2004 |
| WO | 2005/090739 | 9/2005 |

* cited by examiner

SELF-ALIGNING OPEN-HOLE TRACTOR

CROSS REFERENCE TO RELATED APPLICATION(S)

This Patent Document claims priority under 35 U.S.C. §119(e) to U.S. Provisional Application Ser. No. 60/890,577, entitled Method to Convey Downhole Tools in an Open Hole, filed on Feb. 19, 2007, which is incorporated herein by reference.

FIELD OF THE INVENTION

Embodiments described herein relate to tractors for delivering tools through hydrocarbon wells. In particular, embodiments of centralized tractor assemblies capable of maintaining substantial driving friction for effective tractoring are described in detail.

BACKGROUND OF THE RELATED ART

Downhole tractors are often employed to drive a well tool through a horizontal or highly deviated well at an oilfield. In this manner, the tool may be positioned at a well location of interest in spite of the non-vertical nature of such wells. Different configurations of downhole tractors may be employed for use in such a well. For example, a passive tractor having tractor arms in the form of separate adjacent sondes with immobilizing traction elements thereon may be employed. With such a tractor, the sondes may alternatingly be immobilized against a borehole casing at the well wall and advanced in an inchworm-like fashion through the well. Alternatively, an active or continuous movement tractor employing tractor arms with driven traction elements thereon may be employed. Such driven traction elements may include wheels, cams, pads, tracks, or chains. With this type of tractor, the driven traction elements may be in continuous movement at the borehole casing interface, thus driving the tractor through the well.

Regardless of the tractor configuration chosen, the tractor along with several thousand pounds of equipment may be pulled thousands of feet into the well for performance of an operation at the well location of interest. In order to achieve this degree of tractoring, radial forces are imparted from the tractor toward the well wall through the noted traction elements. In this manner, the tractor may avoid slippage and be advanced through the well.

The effectiveness of the described radial forces in avoiding slippage and ensuring tractor advancement may depend on the centralized positioning of the tractor within the well. For example, as noted above, the well may be lined with a borehole casing of a circumferential nature. Thus, the tractor may be positioned in a centralized manner relative to the casing in order to ensure that a proper interface of the tractor and the casing is maintained. That is, with a properly centralized tractor, balanced interfacing between the traction elements and the borehole casing may be ensured thereby optimizing the amount of driving friction between the casing and the elements.

In addition to optimizing the traction element-borehole casing interface for improved driving friction, centralization may also provide other tractoring advantages. Furthermore, a proper centralized interface between the casing and the traction elements may help to avoid damage to either feature. That is, damage to the casing or a traction element is a likely result where the tractor is not centralized and unbalanced interfaces are present. Such damage may be the result of a sharp edge of the traction element being radially forced against the borehole casing when the tractor is un-centered.

Additionally, centralization of the tractor may be employed as a manner of keeping track of tractor and tool positioning. For example, it may be preferable that a tool of the toolstring arrive at the operation site in a circumferentially centered manner so as to provide a known orientation or positioning of tools relative to the well and one another. This known orientation may be taken advantage of where tools are to interact during the course of operations, for example where one downhole tool may be employed to grab onto and fish out another.

In order to provide centralization as noted above, a centralizer may be associated with the tractor and toolstring. The centralizer may include radially disposed arms biased outwardly from an elongated body of the tractor for contacting sides of the well wall at the borehole casing, thus, centrally positioning the body of the tractor. As described above, tractor arms, and even a toolstring, may also be coupled to the now centralized elongated body, thereby also providing centralization thereto. Thus, tractoring may proceed in a manner optimizing driving friction as detailed above.

Unfortunately, centralization as described above may fail to ensure the optimization of driving friction at the interface of the traction elements and the well in all circumstances. For example, the above described borehole casing may be of a substantially constant circular shape. As such, centralization of the tractor ensures a position of optimized driving friction for the traction elements relative to the well wall. However, in the case of an open-hole well that is lacking a borehole casing an elliptical or other non-circular well shape may be present. In fact, the morphology of the well may change dynamically as the tractor advances therethrough. As a result, problems may arise even where the tractor is initially centralized with the traction elements in a position of optimized driving friction. For example, as the tractor advances through the well, the morphology of the well may change such that the linearly advancing traction elements are no longer in a position of optimized driving friction relative to the well wall. As such, the tractor may fail to advance due to the lack of optimized driving friction and/or damage to the well wall and traction elements may result as described above.

SUMMARY

A downhole tractor assembly is provided for use in a well at an oilfield. The assembly includes an elongated body with a centralizer for centralizing the assembly in the well and a tractor portion for advancing the tractor in the well. The centralizer and the tractor portion are each independently rotatable about an axis of the elongated body relative to one another.

A method of employing the downhole tractor assembly is also described. That is, the tractor assembly may be positioned within the well with the aid of the centralizer. The assembly may then be advanced through the well with the tractor portion in a centralized manner such that the tractor portion remains free to independently rotate about an axis of the elongated body of the assembly relative to the centralizer.

DETAILED DESCRIPTION

Embodiments are described with reference to certain open-hole tractor configurations. Focus is drawn to a centralizer or centralizing portion adjacent a tractor or tractor portion of a larger tractor assembly. In particular, a centralizing portion that is of a bow spring configuration is depicted adjacent a tractor portion that employs wheeled arms to provide continuous tractor movement. However, a variety of other configurations of centralizing and tractor portions may be employed. Regardless, the portions may be positioned adjacent one another and extend from the same elongated body of the tractor assembly while also being independently rotable about an axis of the body relative to one another. As such, advancement of the tractor assembly through an open-hole well may be enhanced.

Figure 1:
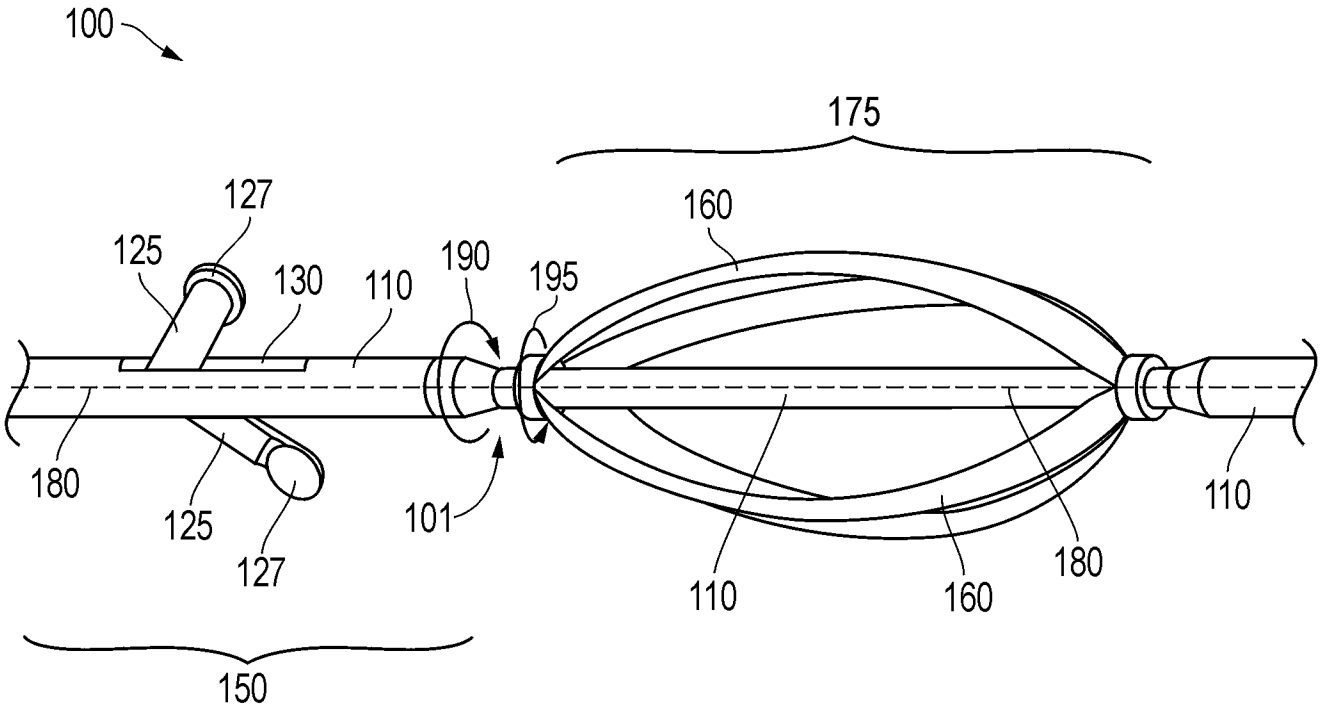
FIG. 1 is a side perspective view of an embodiment of a self-aligning open-hole tractor assembly.

Referring now to FIG. 1, an embodiment of a self-aligning open-hole tractor assembly 100 is shown. The assembly 100 includes a centralizing portion 175 coupled to a tractor portion 150. Of particular note is the fact that the centralizing portion 175 is coupled to the tractor portion 150 in such a manner as to allow the tractor portion 150 to be independently rotable about a longitudinal axis 180 of the assembly 100 relative to the centralizing portion 175. This is evident in the embodiment of FIG. 1, where the tractor portion 150 appears rotable in one direction about the axis 180 that is opposite a potential rotation of the centralizing portion 175 about the axis 180 (see arrows 190, 195). As detailed below, this rotable independence between the portions 150, 175 of the assembly 100 allows the tractor portion 150 to naturally attain a position substantially optimizing the amount of driving friction relative to a wall 250 of a well 200 as the assembly 100 advances through the well 200 (see FIG. 2). Thus, the assembly 100 may be referred to as "self-aligning" in its ability to attain the noted position. This position may be referred to herein-below as one of optimized driving friction.

As shown in FIG. 1, the described independence of rotation of the assembly portions 150, 175 relative to one another is attained through a swivel mechanism 101. The swivel mechanism 101 may be a conventional rotable coupling disposed between the tractor portion 150 and the centralizing portion 175. However, in other embodiments different types of mechanisms may be employed as described below to provide a degree of rotable independence between the assembly portions 150, 175 relative to the longitudinal axis 180 of the assembly 100. Furthermore, the degree of rotable independence between the assembly portions 150, 175 may vary. For example, the swivel mechanism 101 may have some minimal degree of resistance to rotation or perhaps favor rotation in a particular direction. Nevertheless, the assembly portions 150, 175 may be considered substantially independently rotable about the axis 180 relative to one another and are referenced herein as such. As alluded to above and detailed below with reference to FIG. 2, it is this independence of rotation which allows the tractor portion 150 to maintain a substantially optimized driving friction position as the assembly 100 advances through an open-hole well 200 of irregular morphology.

Figure 2:
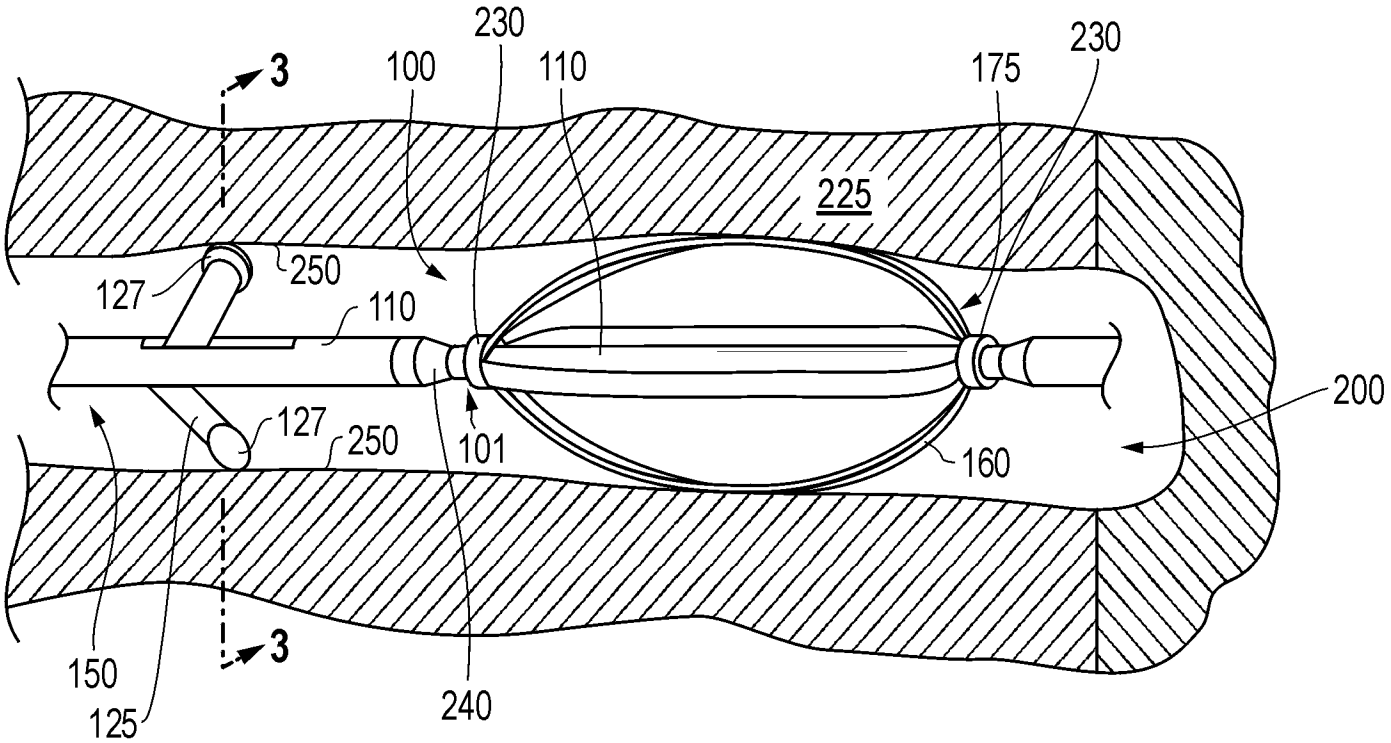
FIG. 2 is a side perspective view of the assembly of FIG. 1 shown centralized within a cross-section of an open-hole well.

Continuing with reference to FIG. 1, with added reference to FIG. 2, the open-hole tractor assembly 100 is shown positioned within an open-hole well 200 through a formation 225. The assembly 100 includes an elongated body 110 from which the tractor portion 150 and the centralizing portion 175 are supported. In the embodiment shown, the tractor portion 150 is configured for continuous movement with arms 125 extending from an arm cavity 130 in the elongated body 110. These arms 125 are equipped with traction elements 127 in the form of wheels. The traction elements 127 may be directed to interface a wall 250 of an open-hole well 200 for advancement of the assembly 100 therein. In this manner, the assembly 100 may be driven in either direction within the well 200 (i.e. uphole or downhole).

While the tractor portion 150 of the assembly 100 is configured for continuous movement with traction elements 127 in the form of wheels, other forms of tractoring may be employed. For example, the traction elements 127 may be in the form of cams, pads, tracks or chains. Additionally, the tractor portion 150 may act in concert with the centralizing portion 175 where the centralizing portion 175 incorporates the capacity to function as one of a pair of 'sondes' for alternating immobilization against the well wall 250 in certain circumstances. In such an embodiment the assembly 100 may be advanced in an inchworm-like manner, similar to the action of a conventional passive tractor with the tractor portion 150 providing added tractoring capacity, and the centralizing portion 175 serving as a fill-in should one of the original sondes of the assembly 100 malfunction.

Continuing with reference to FIGS. 1 and 2, the assembly 100 is also equipped with a centralizing portion 175 in order to aid in centralizing of the tractor portion 150 as well as other portions of the open-hole tractor assembly 100. With respect to the tractor portion 150, this centralizing helps ensure that radial forces from the arms 125 of the tractor portion 150 may be evenly distributed toward the wall 250 of the well 200. Thus, stable and smooth tractoring by the tractor portion 150 may be furthered.

In the embodiment shown, the centralizing portion 175 is of a bow spring configuration with several bow springs 160 extending from the elongated body 110 and disposed between bow cuffs 230 about the body 110. However, in alternate embodiments, other conventional types of centralizers, such as a roller centralizer, may be employed in order to help centralize the adjacent tractor portion 150 and other nearby equipment of the elongated body 110. Additionally, centralization elements aside from bow springs 160 may be employed, such as rigid arms. Regardless, the elements may be activated by a coiled spring, hydraulic pump, or other means to contact the well wall 250.

Furthermore, the centralizing portion 175, may be independently rotable about the elongated body 110. That is, in place of, or in addition to the swivel mechanism 101, added independent rotability of the centralizing portion 175 relative to the tractor portion 150 may be provided. For example, in one embodiment, the cuffs 230 may be configured to be rotably disposed about the elongated body 110 providing independent rotability to the centralizing portion 175 about the body 110. Resistance to such rotation may be greater due to its occurrence in conjunction with rotation of the entire elongated body 110. Nevertheless, even without the swivel mechanism 101, independence of rotation between the centralizing portion 175 and the tractor portion 150 relative to the axis 180 of the assembly 100 may thereby be achieved.

Continuing now with reference to FIG. 2, the open-hole tractor assembly 100 is shown disposed within an open-hole well 200. The open-hole well 200 is of roughly an elliptical shape in the region where the assembly 100 is positioned (e.g. see the view of FIG. 3). Additionally, with particular reference to FIG. 2, it is apparent in examining the well wall 250 that the exact shape and profile of the well 200 changes when moving from one end of the depiction to the other. Nevertheless, in spite of the changing morphology of the well 200, the assembly 100 is kept relatively centered by the centralizing portion 175.

As alluded to above, the centralizing portion 175 includes bow springs 160 extending from the elongated body 110 of the assembly 100 toward the wall 250 of the well 200. The bow springs 160 are flexible in nature and able to dynamically flatten or bow relative to the wall 250 as the assembly 100 advances through the well 200. For example, assuming the assembly 100 is advanced to the right in the depiction of FIG. 2, the visible narrowing of the well 200 relative to the upper and lower bow springs 160 may result in the flattening of these bow springs 160. This responsive change in shape of these bow springs 160 occurs keeping the centralizing portion 175 and the body 110 of the assembly 100 in a relatively centralized position with respect to the well 200. That is, in response to the changing well morphology, the centralizing portion 175 truly provides significant centralization to the elongated body 110 as it is advanced through the well 200. As described further below, keeping the body 110 substantially centralized as noted may play a key role in maintaining sufficient driving friction between the wall 250 of the well 200 and the traction elements 127 of the tractor portion 150. In this manner continued advancement of the assembly 100 through the well 200 may be ensured and undue damage to the traction elements 127 and the wall 250 avoided.

Figure 3:
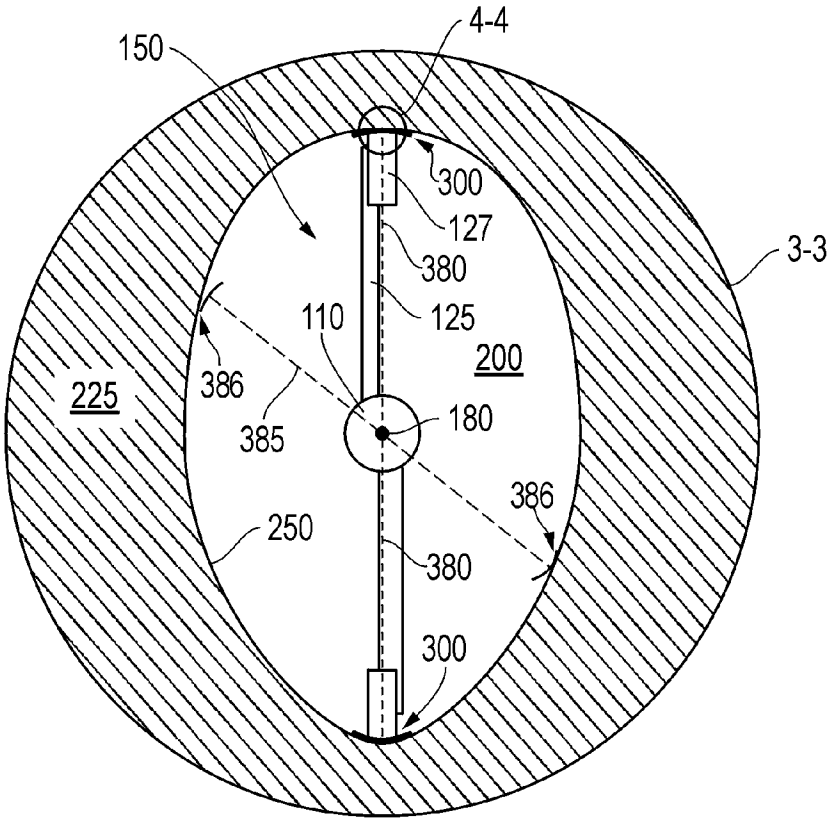
FIG. 3 is a cross-sectional depiction of the assembly taken from 3-3 of FIG. 2, revealing a front view of an interface between the well and a tractor portion of the assembly.

Continuing with reference to FIG. 3, with added reference to FIG. 2, the elliptical shape of the well 200 taken from the cross-section of 3-3 of FIG. 2 is readily discernible. The elongated body 110 and longitudinal axis 180 therethrough are maintained in a relatively centralized position of the well 200 by the centralizing portion 175 as described above. As such, each arm 125 of the two-armed tractor portion 150 may extend roughly the same distance to the wall 250 of the well 200. Thus, a balance of radial forces may exist with each arm 125 exerting about the same amount of force on the wall 250 through the respective traction elements 127. In the embodiment shown, the traction elements 127 are wheels. As such, a coordinated rotation of the wheels may be employed to drive the assembly 200 through the well 200 so long as sufficient driving friction is maintained.

Driving friction for the assembly 100 is determined based on the interface 300 of the traction elements 127 and the wall 250 of the well 200. In particular, the positioning of the traction elements 127 based on the orientation of the tractor portion 150 relative to the wall 250 may be key to attaining the optimum driving friction at the interface 300. That is, in addition to centralization as described above, driving friction may be optimized by ensuring the proper orientation of the tractor portion 150 within the well 200 so as to ensure stable gripping of the wall 250 by the traction elements 127. Thus, for example, as depicted in FIG. 3, the tractor portion 150 may be oriented or aligned along different possible vertical axis 380, 385 relative to the wall 250 of the well 200. However, as described below, it is an alignment along a substantially perpendicular vertical axis 380 relative to the wall 250 which optimizes driving friction.

Figure 4:
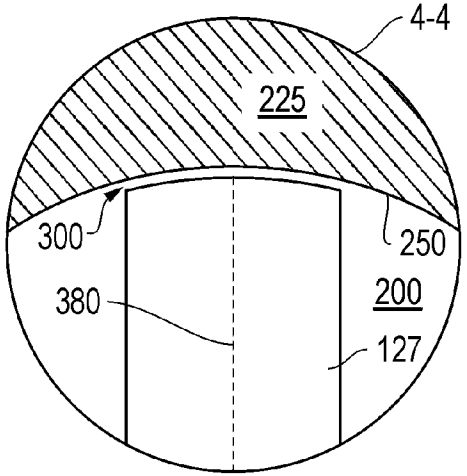
FIG. 4 is an enlarged view of the interface taken from 4-4 of FIG. 3.

Continuing with reference to FIGS. 3 and 4, the tractor portion 150 is shown oriented along a substantially perpendicular vertical axis 380. That is, each arm 125 of the 180° two armed configuration of the embodiment shown is roughly aligned with the axis 380. As such, each traction element 127 at the end of each arm 125 contacts the wall 250 with a optimum amount of its surface (see FIG. 4). This results in a balanced interface 300 with optimized driving friction. In the embodiment shown, the perpendicular vertical axis 380 is found across the largest possible diameter of the well 200. However, a vertical axis that is substantially perpendicular may also be found across the smallest possible diameter of the irregularly shaped open-hole well 200. Alignment with such an axis by the tractor portion 150 would similarly provide optimized driving friction as described.

While alignment with the perpendicular vertical axis 380 as noted above provides a balanced interface 300 of optimized driving friction, alternative orientations of the tractor portion 150 within the well 200 would fail to provide such optimized driving friction. For example, a slanted axis 385 is depicted across the open-hole well 200 in FIG. 3. Alignment of the tractor portion 150 with this slanted axis 385 would result in unbalanced interfaces 386. That is, unlike the substantial matching that is apparent in FIG. 4 between the surface of a traction element 127 and the well wall 250 at the balanced interface 300, the unbalanced interfaces 386 would include traction elements 127 contacting the wall 250 in an off-kilter fashion. That is, disproportionate and unbalanced radial forces would be transmitted more to one side of the traction elements 127 while the other side of the traction elements 127 may fail to transmit as much force or perhaps fail to even contact the wall 250 at all.

Depending on the degree of unbalanced forces involved, the amount of damage to the unshielded (i.e. uncased) formation 225 inflicted by the traction elements 127 during tractoring may be increased as well as increased wear and damage to the traction elements 127 themselves. Additionally, if the tractor portion 150 is aligned with such a slanted axis 385, the unbalanced interfaces 386 may result in a reduction in driving friction that is significant enough to prevent tractoring altogether. However, as alluded to above, embodiments described herein include a tractor portion 150 that is configured for substantially self-aligning with a perpendicular vertical axis 380 across the well 200 so as to help optimize driving friction while also minimizing damage to the well wall 250 and traction elements 127.

Continuing now with reference to FIGS. 1-3, the self-aligning nature of the tractor portion 150 is further described. That is, as indicated above, alignment of the tractor portion 150 with a perpendicular vertical axis 380 as depicted in FIG. 3 may be employed for effective tractoring of the tractor assembly 100. However, as also described above, the open-hole nature of the well 200 is such that its morphology may dynamically change as the assembly 100 is advanced therethrough. With particular reference to FIG. 2, for example, a perpendicular vertical axis 380 such as that of FIG. 3 may be found at about 3-3 in alignment with the arms 127 of the tractor portion 150, much as described above with respect to FIG. 3. However, this may change. For example, assuming the tractor portion 150 is advanced from the position depicted in FIG. 2 to the right, the orientation of the perpendicular vertical axis 380 may change (i.e. rotate). That is, given the changing morphology of the well 200 from location to location, the largest (or smallest) distance across the well 200 may also change from location to location.

In order to allow the tractor portion 150 to maintain alignment with a perpendicular vertical axis 380 of changing orientation, the tractor portion 150 may be configured to be rotable. As indicated above, this rotability may be provided by a swivel mechanism 101 positioned between the tractor portion 150 and the centralizing portion 175 of the tractor assembly 100. However, alternative rotable means may be provided. Regardless, as also noted, the tractor portion 150 and centralizing portion 175 may be independently rotable about a longitudinal axis 180 of the assembly 100. This can be seen with reference to FIG. 1 in that the tractor portion 150 appears rotable in one direction about the longitudinal axis 180 with the centralizing portion 175 rotable in an opposite direction (see arrows 190, 195).

With the tractor portion 150 free to rotate about the longitudinal axis 180 as described, it is now feasible that its arms 125 may be dynamically aligned with the perpendicular vertical axis 380 during tractoring through the well 200. That is, while the centralizing portion 175 and the remainder of the assembly 100 may be prone to remaining in a relatively constant orientation during advancement within the well 200, the tractor portion 150 may nevertheless be free to change orientation in accordance with the changing orientation of the perpendicular vertical axis 380. In this manner, a balanced interface 300 for effective tractoring may be achieved.

Continuing with reference to FIGS. 1-3, the balanced interface 300 may be achieved due to the freedom of rotation afforded the tractor portion 150. However, embodiments described herein not only allow for, but may in fact favor, a condition of tractor portion 150 alignment with the perpendicular vertical axis 380, thereby maintaining the balanced interface 300 during tractoring. Thus, the assembly 100 may truly be "self-aligning". This is furthered by use of a two-armed tractor portion 150 with arms about 180° apart from one another as shown. That is, with such a configuration, radial forces exerted on the arms 125 may encourage them to take on the largest attainable separation from one another. As such, the traction elements 127 may seek to interface the well wall 250 at locations separated by from one another by the largest possible diameter of the well 200 (i.e. in accordance with the larger perpendicular vertical axis 380). Sufficient radial forces to achieve rotation as described may be between about 1.5 to 2 times the weight of the tractor portion 150. Thus, in an embodiment where the tractor portion 150 is between about 250 lbs. and about 350 lbs., up to about 700 lbs. of force may be exerted through the arms 125 in order to achieve the described orientation.

The assembly 100 may prefer a position of optimized driving friction as indicated. However, as also indicated, the orientation of the perpendicular vertical axis 380 may rotate from location to location within the well 200. Thus, in order to maintain a position of optimized driving friction, the tractor portion 150 of the assembly 100 may similarly rotate as described, maintaining alignment with the dynamic perpendicular vertical axis 380. This is achieved as radial forces imparted through the traction elements 127 drive them to change position as they move along the wall 250 of the well 200 at the interface 300. For example, traction elements 127 in the form of rolling wheels as depicted in FIGS. 2-4 may be steered by radial forces across the surface of the wall 250 in a direction and manner that maintains alignment with the largest possible diameter of the well 200. Due to the presence of a swivel mechanism 101 or other rotable means, steering of the traction elements 127 in this manner is not impeded by any immobility of the elongated body 110 or other assembly portions. Thus, rotation of the tractor portion 150 is permitted and self-alignment with the perpendicular vertical axis 380 is maintained as the tractor is advanced.

Figure 5:
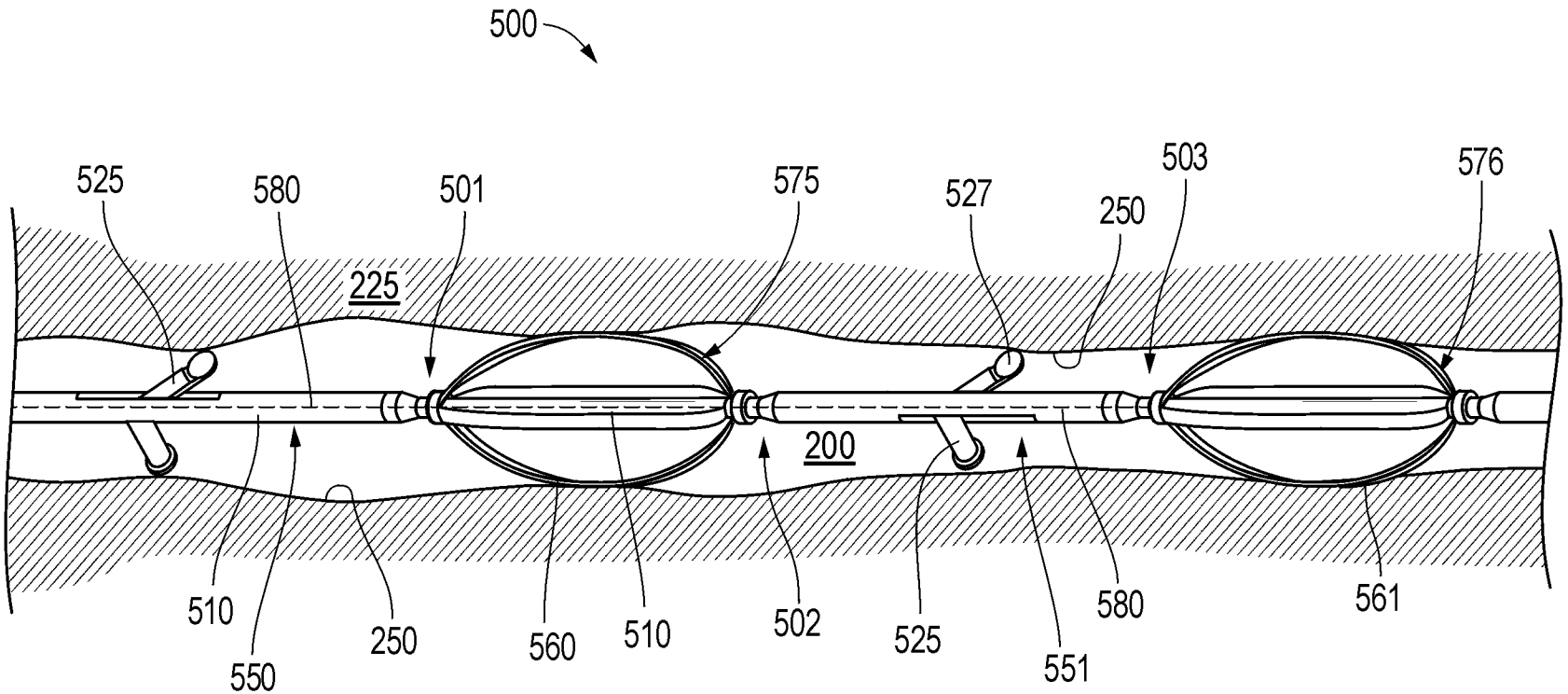
FIG. 5 is a side perspective view of an alternate embodiment of a self-aligning open-hole tractor assembly centralized within a cross-section of the open-hole well of FIGS. 2-4.

Referring now to FIG. 5, an alternate embodiment of a self-aligning open-hole tractor assembly 500 is shown. In this embodiment, a host of assembly portions 550, 575, 551, 576 supported by an elongated body 510 are linked to one another in series. The portions 550, 575, 551, 576 are arranged with tractor portions 550, 551 and centralizing portions 575, 576 alternating along the body 510 with swivel mechanisms 501, 502, 503 disposed therebetween.

The assembly 500 of FIG. 5 operates similar to that of FIGS. 1-4. For example, in the embodiment shown, the centralizing portions 575, 576 include bow springs 560, 561 for providing centralization to the assembly 500 with respect to the well 200 similar to the embodiments described above. However, with multiple centralizing portions 575, 576, the length of the assembly 500 that may be centered within the well 200 may be increased. Thus, tractor portions 550, 551 may be alternatingly disposed between the centralizing portions 575, 576 for appropriate centering thereof. Indeed, each tractor portion 551 disposed between two separate centralizing portions 575, 576 and swivel mechanisms 502, 503 would have the advantage of centralization forces applied at both ends thereof. In such an embodiment this would be the case for all but the most uphole and most downhole positioned tractor portions (e.g. 550).

Continuing with reference to FIG. 5, radial forces may be applied to a host of traction elements 527 through arms 525 of the tractor portions 550, 551 for interfacing a geologic formation 225 at the open-hole well wall 250. The tractor portions 550, 551 may thus be employed for driving of the assembly 500 through the well 200 similar to the embodiments detailed above. Additionally, however, the use of multiple tractor portions 550, 551 may provide additional tractoring capacity to the assembly 500.

While the overall assembly 500 of FIG. 5 operates similar to embodiments of FIGS. 1-5, the addition of multiple assembly portions 550, 575, 551, 576 provides the assembly 500 with a segmented and extended snake-like region of increased stability, centralization and overall enhanced tractoring capacity. This segmented region of multiple assembly portions 550, 575, 551, 576 includes multiple swivel mechanisms 501, 502, 503 for allowing each assembly portion 550, 575, 551, 576 to independently rotate about a longitudinal axis 580 of the assembly 500. Thus, each tractor portion 550, 551 is able to maintain a position of optimized driving friction as detailed above. In fact, irrespective of the self-aligning nature of an advancing tractor portion 550, 551, the presence of swivel mechanisms 501, 502 disposed at either side of a centralizing portion 575 provides the added advantage of allowing a degree of rotability to be displayed by such a portion 575 within the well 200 as needed.

Embodiments described hereinabove provide for a self-aligning open-hole tractor assembly in which a optimization of driving friction may be realized throughout downhole tractoring. That is, driving friction may be optimized at the interface of traction elements and a wall of a well (even in circumstances of an open-hole well of irregular and changing morphology). In this manner, sufficient driving friction may be maintained so as to ensure continuous tractoring of the tractor assembly through the well. In fact, the self-aligning nature of the tractor assembly may help to avoid damage to the formation as well as the traction elements as a result of the maintained balanced interface therebetween.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. As such, the foregoing description should not be read as pertaining only to the precise structures described and shown in the accompanying drawings, but rather should be read as consistent with and as support for the following claims, which are to have their fullest and fairest scope.

We claim:

1. A self-aligning open-hole tractor assembly adapted for use in a subterranean open-hole wellbore comprising:

an elongated body;

a first centralizing portion extending from said elongated body;

a second centralizing portion extending from said elongated body; and a first tractor portion disposed intermediate said first centralizing portion and said second centralizing portion, the first tractor portion independently rotatable with respect to each of the centralizing portions, and the centralizing portions each independently rotatable with respect to the elongated body and the first tractor portion, the first tractor portion configured to adjustably engage the wall of the wellbore and drive the assembly along the wellbore and comprising no more than one pair of radially extending circumferentially spaced arms, disposed about 180 degrees apart around said elongated body, the arms having respective traction elements at their outer ends, said arms being urged radially outwardly from the body to urge the traction elements into engagement with the wall of the borehole, the arms adapted to align themselves with the largest diameter of the well to permit the tractor assembly to self-align within the open-hole wellbore and maintain optimized driving friction within the open-hole well; and a second tractor portion disposed adjacent said second centralizing portion, wherein said second centralizing portion is between said first tractor portion and said second tractor portion, said second tractor portion extending from said elongated body for independently rotating about the longitudinal axis relative to said first centralizing portion, said second centralizing portion, and said first tractor portion.

2. The self-aligning open-hole tractor assembly of claim 1 further comprising:

a first swivel mechanism of said elongated body disposed between said first tractor portion and said second centralizing portion; and a second swivel mechanism of said elongated body disposed between said second tractor portion and said second centralizing portion, said first swivel mechanism and said second swivel mechanism to provide a degree of independence of rotation to said second centralizing portion about the longitudinal axis relative to said first centralizing portion, said first tractor portion and said second tractor portion.

3. The self-aligning open-hole tractor assembly of claim 1, wherein the centralizing portions comprise a plurality of bow springs extending from the elongated body.

4. The self-aligning open-hole tractor assembly of claim 1, wherein the centralizing portion is connected with the elongated body by cuffs, and wherein the cuffs are rotatable about the elongated body.

5. The self-aligning open-hole tractor assembly of claim 1, wherein the traction elements are wheels, cams, pads, track, chains, or combinations thereof.

6. The self-aligning open-hole tractor assembly of claim 1, wherein the arms of pair of radially extending circumferentially spaced arms extend from an arm cavity.

7. The self-aligning open-hole tractor assembly of claim 1, wherein the traction elements are wheels.

8. The self-aligning open-hole tractor assembly of claim 1, wherein the traction elements are cams.

9. The self-aligning open-hole tractor assembly of claim 1, wherein the traction elements are pads.

10. The self-aligning open-hole tractor assembly of claim 1, wherein the traction elements are tracks.

* * * * *